United States Patent [19]

Baker

[11] Patent Number: 4,752,357

[45] Date of Patent: Jun. 21, 1988

[54] ON-LINE APPARATUS FOR DETERMINING DEGREE OF COMPLETION OF PULP COOK

[75] Inventor: Clifford Baker, New London, Wis.

[73] Assignee: Paper Valley Instruments, Inc., Neenah, Wis.

[21] Appl. No.: 944,201

[22] Filed: Dec. 22, 1986

[51] Int. Cl.[4] ..... D21C 7/12

[52] U.S. Cl. ..... 162/263; 162/49; 162/238; 422/62; 422/68; 73/61 R

[58] Field of Search ..... 162/49, 238, DIG. 10, 162/ 61, 263; 73/61 R, 63, 53; 422/62, 68; 436/52

[56] References Cited

U.S. PATENT DOCUMENTS

| | | | |
|---|---|---|---|
| 3,838,594 | 10/1974 | Kesler | 162/263 |
| 4,192,708 | 3/1980 | Bergstrum et al. | 162/49 |
| 4,345,913 | 8/1982 | Jönsson | 162/49 |

*Primary Examiner*—Steve Alvo

*Attorney, Agent, or Firm*—James E. Nilles

[57] ABSTRACT

A method and suitable apparatus for periodically analyzing pulp stock, including wood pulp and water, in a pulp digester, which may or may not be part of a paper machine, to determine the amount of cooking to which the pulp has been subjected. The method includes diluting a sample of the pulp stock from the digester, diluting the sample to a predetermined range of consistency, and determining the exact consistency of the sample. Consistency can be determined by any suitable commercially available apparatus. Next, substantially all the water is removed from the sample. A reagent, preferably a 14 percent solution of nitric acid in water, is then added to the sample and allowed to react with the sample for a predetermined time interval at a predetermined temperature. The light absorbance of the reagent during and after the reaction is determined by the amount of cooking to which the pulp has been subjected and the consistency of the sample. Finally the reagent is removed from the sample and examined, such as by use of a colorimeter, to determine the light absorbance of the reagent. The amount of cooking is then determined from a known relationship thereof to the light absorbance of the reagent and the consistency of the sample.

4 Claims, 4 Drawing Sheets

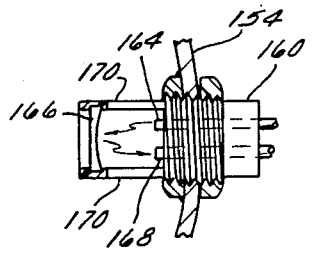
FIG. 6
FIG. 2
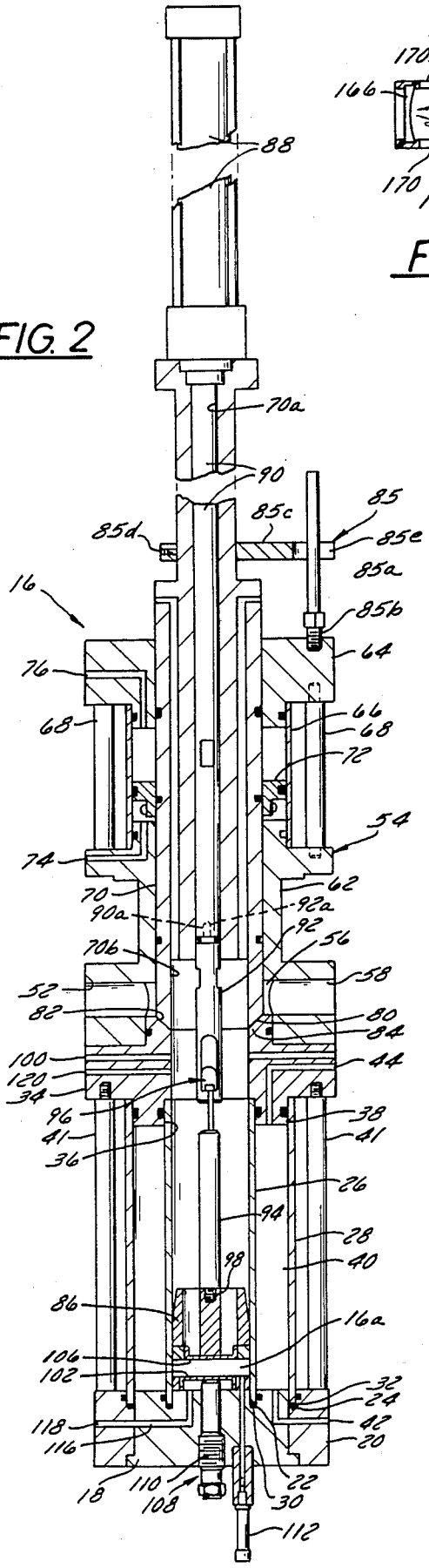
FIG. 3
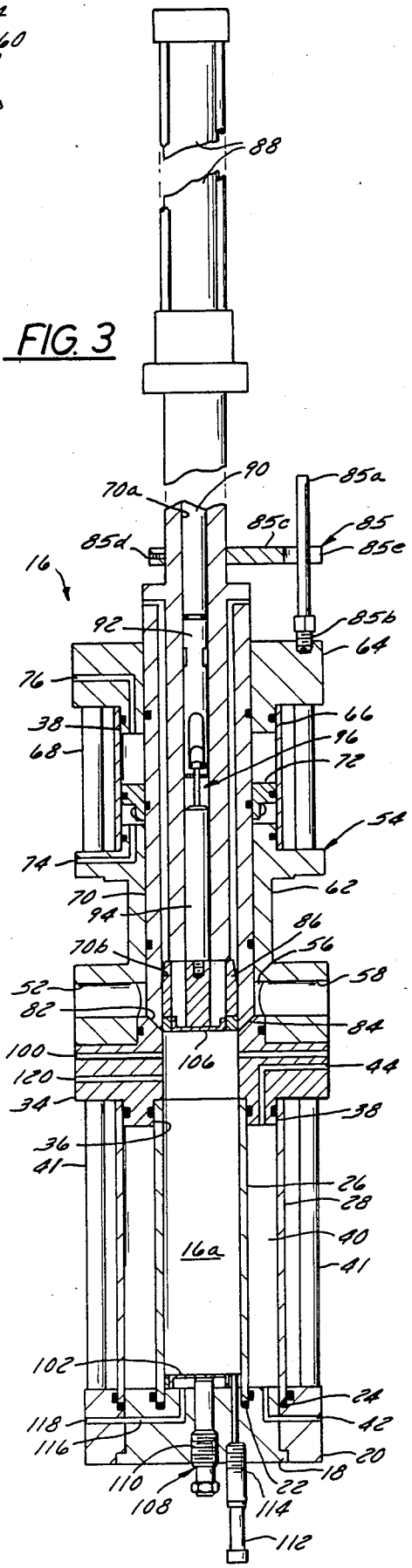

ON-LINE APPARATUS FOR DETERMINING DEGREE OF COMPLETION OF PULP COOK

BACKGROUND OF THE INVENTION

This invention relates to methods and apparatus for determining the degree of completion and residual lignin content in a digesting or delignification reaction. More particularly, the invention provides an integral part of a closed-loop control system for controlling a digester so as to produce pulp with the proper amount of "cook" for the particular desired paper product.

The sequence of operations in the chemical manufacture of wood pulp preparatory to the production of paper includes debarking of the wood, chipping or fragmenting of the wood, pulping of the chipped wood, and subsequent bleaching, washing, cleaning and screening of the pulp. Although the pulping step is fundamental to the production of paper, the pulping reaction itself is not completely understood. Commonly used chemical pulping processes include the sulfite process and the kraft (or basic) process. While the kraft process is the dominant process practiced industrially, accounting for approximately three-fourths of the total pulp production, fine and writing papers are generally produced using the sulfite process. Both processes are conducted by both batch and continuous methods.

Generally, the control of either pulping process has been accomplished by means of an open loop, feed forward system. According to the most common method, the initial charge conditions such as chip moisture content, sulfidity, liquor to wood ratio, and acidity or alkalinity are monitored. Cooking over a given time and at a given temperature for particular values of these conditions is expected to result in the same pulp yield and Kappa number, or lignin content. The cook is then stopped at a time which is expected to give an acceptable pulp yield. Hence this conventional method is used to predict when to stop the cook in order to achieve a desired pulp yield. Upon stopping the cook, the pulp is analyzed to ascertain whether the desired degree of completion has in fact been attained. The results of this analysis are used to adjust the cooking parameters to be used on subsequent cooks.

One clear disadvantage of this conventional method is that control of the product of the pulping operation is dependent upon the maintenance of uniform conditions of chip moisture content, temperature and chemical properties. It is very difficult to accurately ascertain certain of these variables such as chip moisture in any practical way. Accordingly the results of one reaction are used to correct the conditions for the next run in a trial and error operation based on the questionable assumption that the average properties of the components remain substantially uniform from one cook to the next. Thus it has not been possible to close the open control loop of the conventional method because of the lack of suitable process measurements.

Another approach to controlling the completeness of the pulp delignification process has been the method of measuring the "Kappa number", which is defined by the Technical Association of the Pulp and Paper Industry (TAPPI) standard T-236. The known relationship between the Kappa number and the lignin content is as follows: the percent lignin in the pulp equals 0.147 times the Kappa number. The Kappa number method, however, is not suitable for on-line measurement because the pulping reaction must be terminated and the pulp ovendried in order to measure the Kappa number. Certain models have been developed over time to aid in inferring the Kappa number from measurement of other parameters, such as the measurement of sulfidity of the liquor by a selective ion electrode, or the titration of a liquor sample by acid. These methods have not received wide used within the industry. Virtually all of the pulping control done in this country employs the conventional method described above or equivalent feed forward control.

The patent issued to Pottenger, U.S. Pat. No. 3,674,434, teaches a system for determining the lignin content "directly", by measuring the ratio of elemental carbon to elemental hydrogen in a sample. Since this method requires termination of the reaction for direct sampling of the pulp, it is unsuited for online real time monitoring and process control.

The patent issued to Andrews, Jr., et al., U.S. Pat. No. 4,193,840, teaches a method for determining the degree of delignification by monitoring a combination of temperature and pressure. Because these parameters are only indirectly related to the lignin content of the pulp, reliability of the measurements is suspect.

The patent issued to Chase, et al., U.S. Pat. No. 4,162,933, determines the degree of delignification by monitoring heat given off by the chemical reaction of the digesting operation. Once again, the information taken is only indirectly related to the lignin content of the pulp, and so the reliability required for an on-line process control system is unavailable.

The Institute of Paper Chemistry (IPC) has disclosed a technique using the carbohydrate fraction of pulp to predict yield in continuous digesters. The method assumes that the yield of cellulose as a percentage of a particular wood species is substantially constant during a Kraft reaction. The method requires extremely accurate determination of pulp carbohydrates, such as by gas chromatography, thus being too expensive to be widely applicable to on-line real time measurement of pulp yield.

This invention relates to improvements over the methods and apparatus described above and to solutions to the problems raised thereby.

SUMMARY OF THE INVENTION

The invention includes a method and suitable apparatus for periodically analyzing pulp stock, including wood pulp and water, in a digester of a paper machine, to determine the amount of cooking to which the pulp has been subjected. The method includes taking a sample of the pulp stock from the digester, diluting the sample to a predetermined range of consistency, and determining the exact consistency of the sample. Consistency can be determined by any suitable commercially available means. Preferably, however, the apparatus of the invention would include a consistency tester. Next, substantially all the water is removed from the sample. A reagent, preferably a 14 percent solution of nitric acid in water, is then added to the sample and allowed to react with the sample for a predetermined time interval at a predetermined temperature. The color and clarity of the reagent during and after the reaction is determined by the amount of cooking to which the pulp has been subjected and the consistency of the sample. Finally the reagent is removed from the sample and examined, such as by use of a colorimeter, to determine the color and clarity of the reagent. The amount of cooking is then determined from a known relationship thereof to the color and clarity of the reagent and the consistency of the sample.

It is thus an object of the invention to provide a method ano apparatus for determining the degree of completion of cook of the pulp in a digester, including means for automatically determining the consistency of the pulp, adding a reagent to the pulp, allowing the reagent to react with the pulp at a predetermined temperature for a predetermined time interval, and thereafter examining the reagent to determine its color and clarity. The color and clarity of the spent reagent combine in a known relationship with the consistency to give a reference number in a standard scale determining the amount of cooking to which the pulp has been subjected.

Other objects and advantages of the invention will become apparent hereinafter.

DESCRIPTION OF THE DRAWING

FIG. 2 is a plan view, partially in cross-section, of a cylinder to used in the apparatus shown schematically in FIG. 1, with the piston in the lowered position.

FIG. 3 is a view of the cylinder similar to FIG. 2, except with the piston moved to the raised position.

FIG. 6 is a sectional view of a transmittance chamber constructed according to the invention, showing the transmittance sensor located therein.

DESCRIPTION OF THE PREFERRED EMBODIMENTS

Figure 1A:
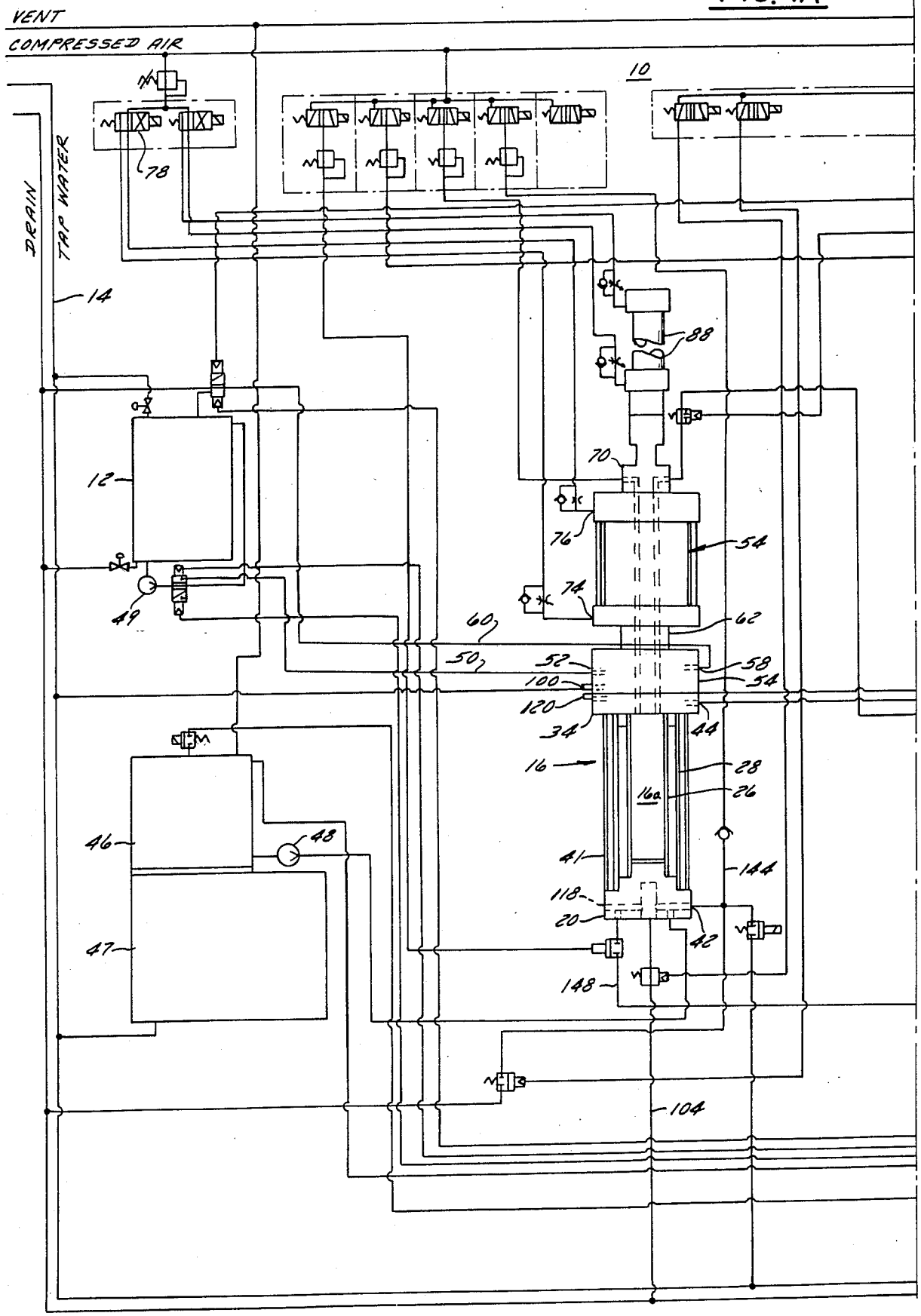
FIGS. 1A and 1B are the two parts of a schematic diagram of an apparatus assembled according to one embodiment of the invention.
Figure 1B:
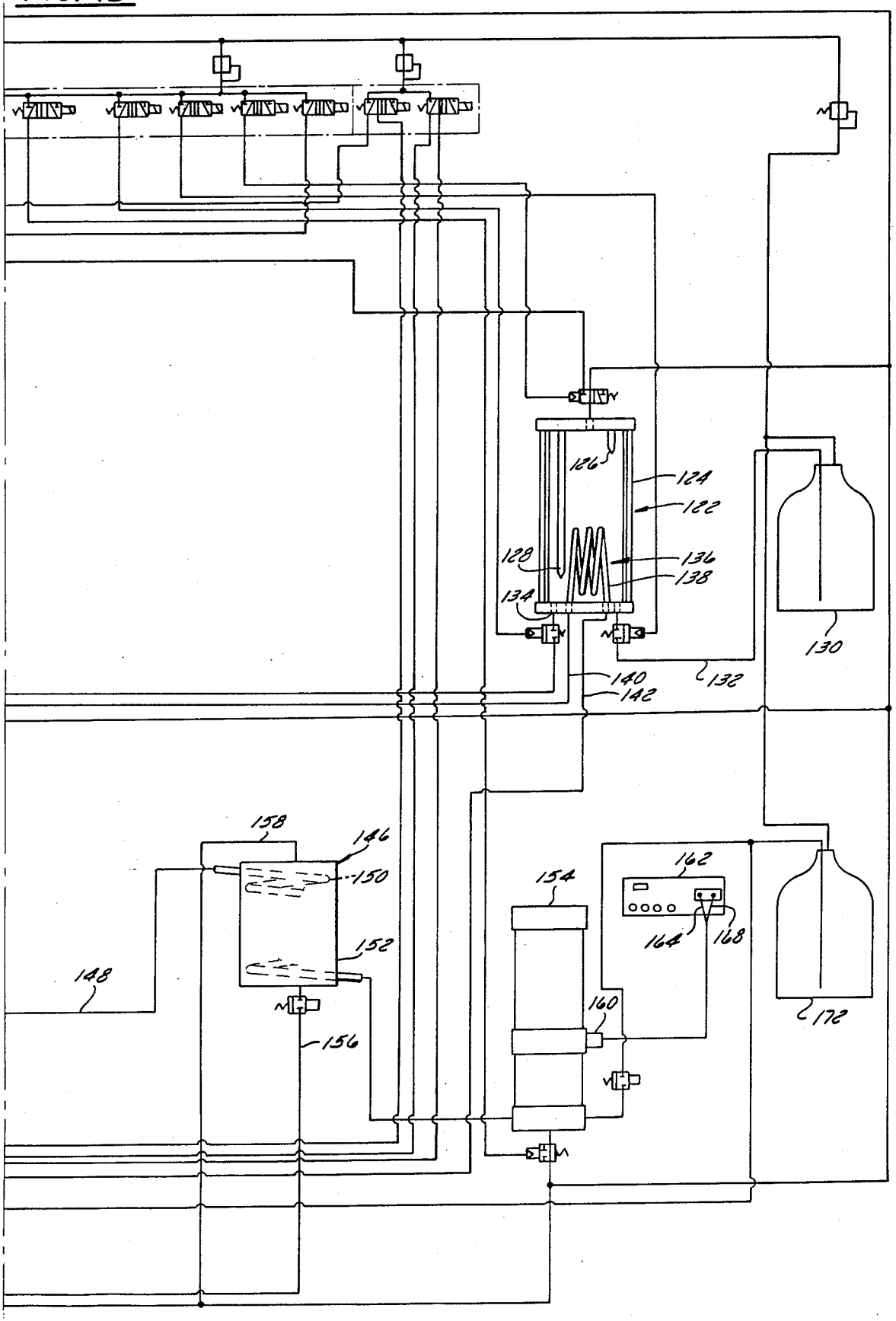

Referring now to FIGS. 1A and 1B, there is shown a schematic diagram of an apparatus 10, constructed according to a preferred embodiment of the invention, for testing to determine the amount of cook to which a sample of pulp has been subjected. An understanding of the method of the invention will be more easily attained by reference to the apparatus 10. It should be understood that the various filling, draining and air movement operations disclosed below are controlled by suitable valves as is well known in the art. Hence these valves are generally not referenced individually. They may be controlled by any suitable control means, whether electronic, mechanical or even by a human operator.

Generally, the apparatus 10 includes a dilution tank 12 into which is added a sample of pulp slurry taken directly from the stock lines of a digester (not shown). A rough approximation of the consistency of the sample is generally known in advance by the operator taking the sample. The sample is then diluted by the addition of water from a source 14 of tap water until a consistency range of about 0.4% to about 0.6%, and preferably about 0.5%, is reached in the dilution tank 12. The diluted pulp is then, on command of the operator, introduced into a reaction chamber 16, where it is subjected to certain tests and reactions as will be explained in more detail subsequently. Generally a single testing cycle will be sufficient to determine the amount of cook to which the pulp has been subjected.

Reaction Chamber

As can be seen in more detail by reference to FIG. 2, the reaction chamber 16 includes, at the bottom thereof, a header core 18 and header ring 20. When assembled together as there shown, inner and outer annular grooves 22 and 24 respectively are produced, concentric with each other. Into these grooves 22 and 24 are inserted an inner cylindrical wall 26 and an outer cylindrical wall 28 respectively. O-rings 30 and 32 or other sealing means may be placed at the bottom of the grooves 22 and 24 respectively for sealing purposes prior to assembly of the walls 26 and 28 into the grooves. As shown in FIG. 2, an upper header 34, having an inner axial bore 36 and a lower outer surface 38, is similarly mounted at the top of the cylindrical walls 26 and 28. Hence an enclosed annular space 40 is provided between the cylindrical walls 26 and 28, and between the upper header 34 at the upper end and the header core 18 and header ring 20 at the bottom end. Preferably the upper header 34 is attached to the header ring by suitable removable means such as tie rods 41 threaded into tapped holes in each of header ring 20 and upper header 34 at locations outside of outer cylindrical wall 28. In the annular space 40 is provided a water jacket for controlling the temperature of the reaction chamber 16 and maintaining it at a predetermined temperature level. A water jacket inlet 42 is provided in header core 18 and a water jacket outlet 44 in upper header 34 for the circulation of hot water or other temperature-regulating fluid from a water heater 46 (FIG. 1A), which heats the temperature-regulating fluid in a tank 47. A circulating pump 48 continuously circulates the heated water from the water heater 46 through the water jacket in the space 40. The reaction chamber 16 is thus formed by header core 18 and header ring 20 at the bottom, inner cylindrical wall 26 and upper header 34 at the top.

Generally, the diluted pulp within the dilution tank 12 is continuously circulated by a stock pump 49 (FIG. 1A) from the dilution tank, via a supply line 50 (FIG. 1A) and a transverse bore 52 (FIG. 2) in a chamber valve body 54 mounted on the upper header 34. From there the diluted pulp circulates to an annular opening 56 above and concentric with the top of the upper header 34 and communicating with transverse bore 52. The diluted pulp then exits via another transverse bore 58, which also communicates with annular opening 56, and finally returns to the dilution tank 12 via return line 60. Preferably chamber valve body 54 includes a combination lower ring-valve body 62 separated from an upper ring 64 by a cylindrical housing 66. Ring-body 62 is preferably attached to upper ring 64 by tie rods 68 threaded into tapped holes in ring-body 62 and upper ring 64 outside of housing 66. Closely fitted in sealing relation within chamber valve body 54 is a valve rod 70, which is moved axially within body 54 by means of an annular valve actuator piston 72. This valve actuator piston 72 is secured to the outer wall of the valve rod 70 and sealingly fitted within housing 66. A lower compressed air aperture 74 is provided in ring-body 62, and a corresponding compressed air aperture 76 in upper ring 64, communicating with a control means 78 (FIG. 1A) to cause the axial movement of the valve rod 70. This axial movement causes the distal end 80 of valve rod 70, having a beveled outer edge and acting as a valve member, to move away from and toward engagement with a valve seat 82 formed by a beveled axial bore in the upper header 34, which bore communicates with the reaction chamber 16 just below. The travel of the valve actuator piston 72 is thus the distance between opposing faces of the ring-body 62 and the upper ring 64. The valve 84 thus formed by valve seat 82, valve rod 70 and ring-body 62 is thus opened and closed respectively thereby. Opening this valve is the first step in initiating a test cycle. Since the valve rod 70 will have a natural tendency to rotate during the axial movement, anti-rotational means 85 are provided to prevent this rotation, since control and supply devices may generally be assumed to be attached to valve rod 70. In the preferred embodiment, this anti-rotational means 85 includes a rod **85*a* attached parallel to the direction of movement of the valve rod 70, such as by threaded fastener means 85*b* to the upper face of upper ring 64. A bracket 85*c* is non-rotatably attached to rod 70 by any suitable means such as a set screw 85*d*. This bracket 85*c* extends transversely toward rod 85*a* and has an aperture 85*e* at the end thereof into which rod 85*a* loosely slidably fits. This arrangement effectively prevents valve rod 70 from rotating with respect to the chamber valve body 54**.

Before a testing cycle can be initiated, however, a chamber piston 86, which is slidable axially within the reaction chamber 16 and closely fitted therein, must be moved out of the chamber, as shown in FIG. 3. This removal is accomplished by a second power cylinder 88, the rod end of which is attached coaxially at the top end of valve rod 70, and the blind end of which extends axially away therefrom. Valve rod 70 is bored at **70*a*, and a cylinder rod 90 of second power cylinder 88 passes through bore 70*a*. A rod extension 92 is connected to the distal end of the cylinder rod 90 by any suitable means such as having a threaded end 92*a* threaded into a tapped hole 90*a* formed axially in the end of rod 90. The distal end of the rod extension 92 is connected to a chamber piston rod 94 by means of a lost motion connection 96. The structure and significance of this lost motion connection 96, as well as the purpose and function of the chamber piston 86, will be explained more fully subsequently. Finally the distal end of the chamber piston rod 94 is connected to the chamber piston 86 by any suitable means such as a threaded fastening means 98. The lengths of the cylinder rod 90, extension rod 92, chamber piston rod 94 and reaction chamber 16 are determined so that, when the cylinder rod 90 is extended fully, the chamber piston 86 reaches the bottom of the reaction chamber with the lost motion connection 96 causing a small amount of lost motion. When the cylinder rod 90 is fully retracted into the second cylinder 88, on the other hand, as shown in FIG. 3, the chamber piston 86 is drawn axially completely out of the reaction chamber 16 and into a recess 70*b* provided for that purpose in the distal end 80 of the valve rod 70**.

Figure 4:
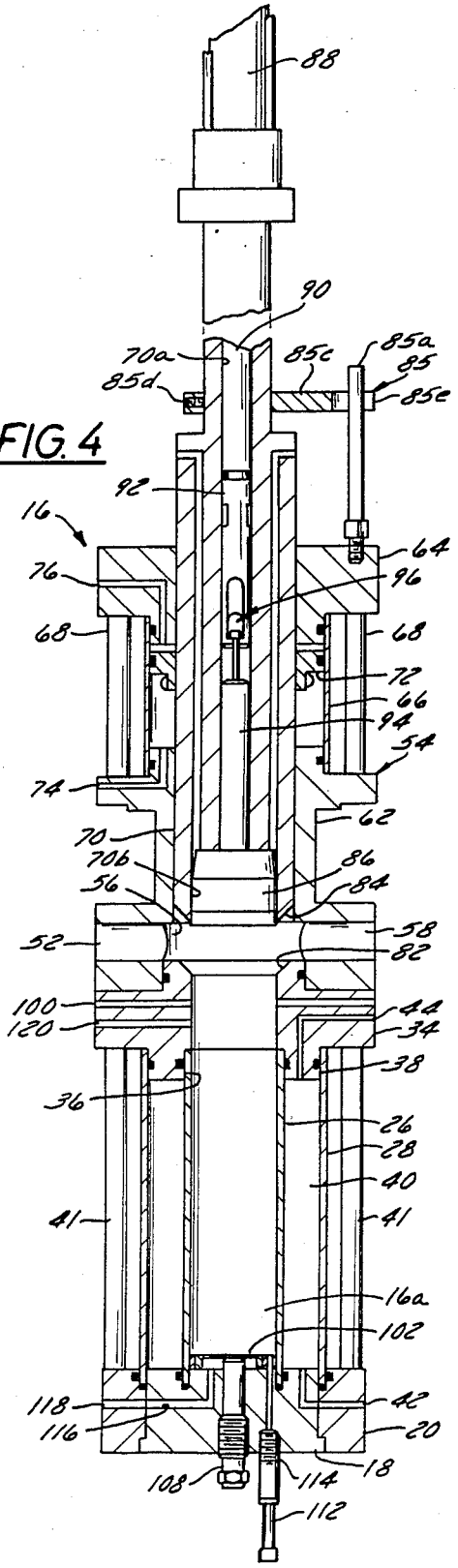
FIG. 4 is a view of the cylinder similar to FIG. 2, except with the main pulp stock inlet valve thereof in its open position.
Figure 5:
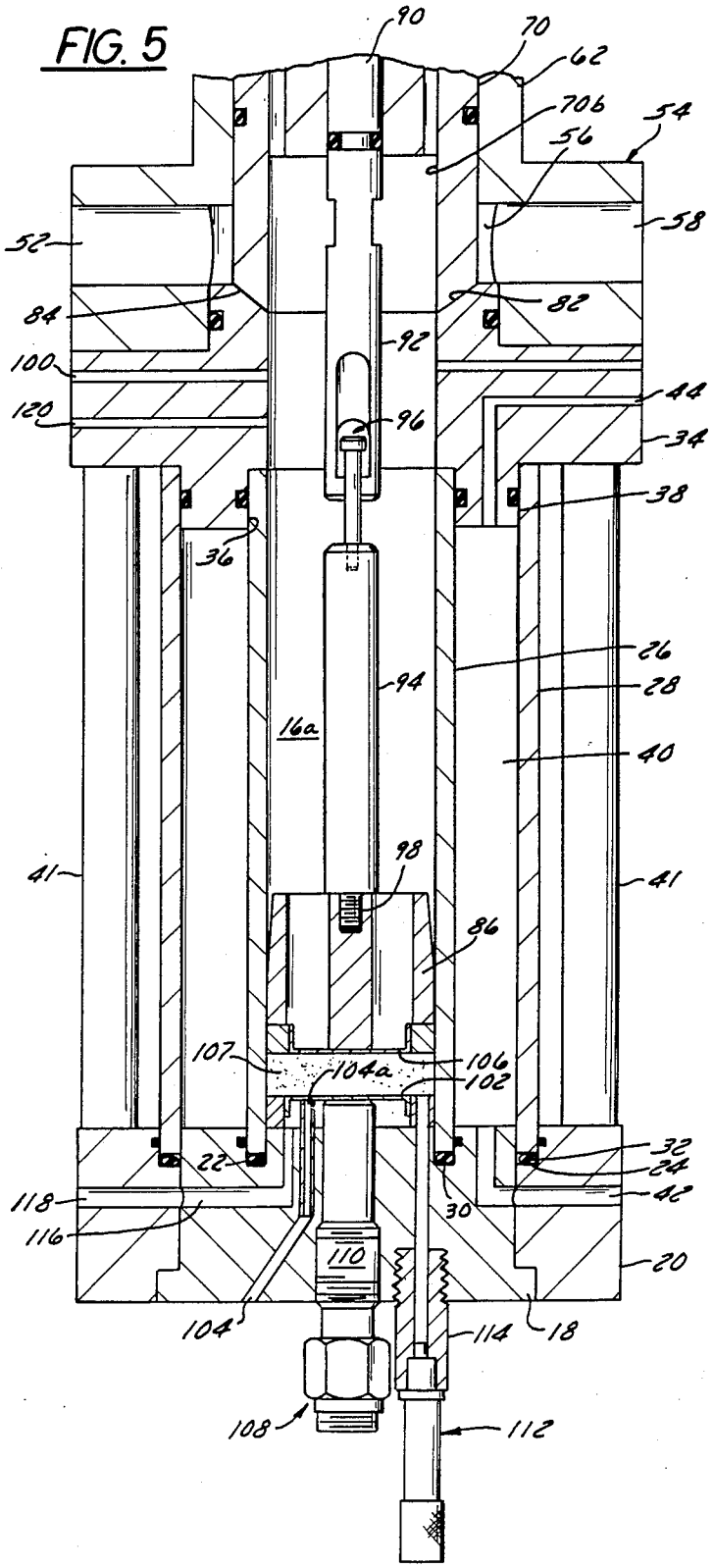
FIG. 5 is an enlarged view of the bottom portion of the cylinder shown in FIG. 2, to show the detail thereof, having the piston in its lowered position.

Having had the chamber piston 86 retracted, the reaction chamber 16 is ready to receive a pulp sample and begin a testing cycle. Referring now to FIGS. 4 and 5, to begin the testing cycle, tap water is allowed into the reaction chamber 16 through a water passage 100, until the water level has reached the level of a stationary screen 102 located at the bottom of the reaction chamber. A separate drain passage 104 (FIG. 5) is provided for this purpose, with its inlet **104*a* positioned at the level of the screen 102. See also FIG. 1A. Accordingly, when valve 84 is opened as shown in FIG. 4 and as explained above to allow the diluted pulp to be charged into the reaction chamber 16 from the supply line 50 (FIG. 1A), pulp does not build up on the screen. The reaction chamber 16 fills in a short time and the valve 84 is then closed, the position in FIG. 3** being resumed.

The Testing Cycle: Consistency

The first step in the testing cycle then is to determine the exact consistency of the pulp sample in the reaction chamber 16. While the approximate consistency is already known from general knowledge of the consistency of the stock in the digester together with the known amount of water added to the stock sample in the dilution tank 12, it is important to know the exact consistency of the pulp sample in the reaction chamber 16 to obtain accurate results. A preferred method of testing for consistency is disclosed generally in Kesler, U.S. Pat. No. 3,838,594, the disclosure of which is incorporated herein by reference.

In the present invention this method is carried out as follows. After the reaction chamber is charged with a sample as described above and the valve 84 closes, the apparatus 10 is again in the position shown in FIG. 3, with the chamber piston 86 fully retracted within the recess **70*b* in distal end 80 of the valve rod 70. At this point second power cylinder 88 is energized, causing the chamber piston 86 to move downward. As referred to above, the chamber piston 86 is fitted closely within inner cylindrical wall 26, in sealing engagement therewith. The lower face of the chamber piston 86 is mostly foraminous, preferably having a chamber piston screen 106 affixed thereto. The apertures of chamber piston screen 106 are sized, as are the apertures of screen 102 at the bottom of the chamber 16, so as to allow the fluid in which the pulp is suspended to pass therethrough, while confining the pulp itself below the screen 106. Thus as chamber piston 86 moves downward the pulp of the sample is confined between the screens at the bottom of the chamber 16, while the liquid in the sample is allowed to remain in the chamber, above the chamber piston. Cylinder 88 is actuated slowly so as not to use up all of the lost motion connection 96, which in turn results in the sample being compressed between screen 102 and chamber piston screen 106 solely by the weight of the chamber piston 86 and chamber piston rod 94, which weight is a known quantity. The result of this compression is a pad 107 of a thickness determined by the pressure applied and the volume of material contained in the pad. After a predetermined length of time compressing the sample, the position shown in FIG. 5 is reached, and the thickness of the pad is measured by a measuring means 108**.

In the preferred embodiment, this measuring means 108 includes a transducer 110 connected to a control unit and indicator panel (not shown) for indicating the distance between the two screens 102 and 106. Preferably, to give the most accurate reading, this transducer 110 is installed axially through the bottom of the header core 18, with the top of the transducer touching the screen 102. For the transducer to work properly, then, the header core 18 must be constructed of a nonmagnetic material that stands up well to corrosive reagents, such as polysulfone, PVC type 2 or Teflon TEF. The screen 102 must also be non-magnetic and corrosion-resistant. The material of the chamber piston 86 must also be corrosion-resistant, but must be ferrous, at least to an extent. Stainless steel is the preferred material. The transducer 110 then senses the distance between the screens 102 and 106 by sensing the distance between itself and the ferrous chamber piston 86. A calibration means 112 is provided to allow calibration of the measuring means 108. To this end, a micrometer screw 114 is provided which can accurately measure the distance between the screens 102 and 106 when no pad 107 is in place, that is, when there is no test in progress. Once again this micrometer screw 114 is preferably inserted axially through the header core 18 parallel to but spaced apart from the transducer 110, and exits the upper surface of the header core 18 alongside the screen 102 or through an aperture provided for that purpose therein. Then, when it is desired to calibrate the measuring means 108, the micrometer is set at a predetermined level at which the calibration is desired and the chamber piston 86 lowered into contact with it. The measuring means is then adjusted accordingly. The micrometer is then withdrawn from the chamber to its storage position as shown in FIG. 5.

Once the thickness of the pad is known, it is simple matter to calculate the consistency of the sample in the reaction chamber 16, employing a reference curve manually generated by use of the apparatus 10 employing principles disclosed in the Kesler patent referred to above. This manual reference curve generation will be necessary for each class of pulp mixture used at a particular mill, because the curve may be different for each such class of pulp, depending upon the wood species or the mixture of hard and soft woods used.

The Testing Cycle: Transmittance

After the consistency of the sample has been determined, the chamber piston 86 is again retracted, returning to the position shown in FIG. 3. The liquid of the sample is drained from the reaction chamber 16 via a drain opening 116 in the header core 18, which in the disclosed embodiment communicates with a similar opening 118 in the header ring 20. Once the liquid is drained, a reagent is added to the pulp via a reagent inlet 120 in upper header 34. As indicated in FIGS. 1A and 1B, reagent inlet 120 is connected to a reagent measuring chamber 122 wherein an exact amount of reagent is premeasured and preferably preheated prior to addition of the reagent to the reaction chamber 16.

In the preferred embodiment, the reagent measuring chamber 122 includes an enclosure 124 and two liquid level sensors, a high level sensor 126 and a low level sensor 128. Between test cycles, the enclosure 124 is filled with reagent from a reservoir 130, via a supply line 132, until the high level sensor 126 is no longer exposed, indicating that the enclosure contains sufficient reagent. Then, when reagent is called for, to be added to the reaction chamber 16, the enclosure 124 is drained via a drain opening 134, which communicates with the reagent inlet 120 of the reaction chamber 16, until the low level sensor 128 is exposed. At that time an exactly known amount of reagent has been added to the reaction chamber 16 and the addition of reagent is discontinued. As mentioned above, the reagent measuring chamber 122 also includes means 136 for preheating the reagent before adding it to the reaction chamber 16. The purpose of this preheating means 136 is to ensure that the reagent enters the reaction chamber 16 at about the same temperature as already exists in the chamber 16, so as not to unduly extend the length of time of the reaction occurring in the chamber 16. To accomplish this purpose, the preheating means 136 includes a coil 138, constructed of temperature conducting material and located within the reagent measuring chamber 122, which communicates with a source of heated fluid. In particular, coil 138 has an inlet 140 connected to the water jacket outlet 44 of the reaction chamber water jacket space 40, and an outlet 142 by which the heated fluid returns to the heater 46. The reagent is thus preheated by coil 138 in the usual fashion by conduction and convection prior to the time it is required to be added to the reaction chamber 16.

The reaction to be conducted in the reaction chamber 16 is an oxidation and breaking down of the fibers of the pulp sample, and a removal therefrom of the lignin. To this end, the preferred reagent is nitric acid. By experimentation it has been determined that the optimum solution of the reagent is a 14% nitric acid solution in water. The reservoir 130 then contains that 14% nitric acid solution. To begin the reaction, the quantity of solution measured by the reagent measuring chamber 122 is introduced into the reaction chamber 16 via reagent inlet 120 as referred to above, the pulp sample 107 still being in the chamber after the consistency testing described earlier. The mixture of pulp and reagent is then agitated by the addition of compressed air to the reaction chamber 16 via an air inlet 144, and allowed to react for a predetermined time interval. The length of the interval is determined in part by experimentation but depends upon the temperature at which the reaction is conducted and upon the type of wood from which the pulp was manufactured. Generally, however, the time interval is within the range from 3 minutes to 12 minutes. Of course shorter reaction times are desireable so that samples can be taken more often and the degree of cook more closely monitored. Generally also the reaction temperatures are in the range from 80 to 95 degrees Celsius. Temperatures toward the higher end of that range cause faster reactions and allow the use of shorter time intervals. In addition the preferred reaction time intervals for pulps manufactured from soft woods range from 4 to 6 minutes, while for hard woods the intervals range from 7 to 10 minutes.

At the end of the interval, the reaction being completed, the reagent is removed from the reaction chamber 16 and passed through a heat exchanger 146 via a drain line 148. The heat exchanger 146 preferably includes a coil 150 of heat conducting material located within an enclosure 152. The inlet of coil 150 communicates with the drain line 148, while the outlet of the coil leads to a transmittance chamber 154. Fresh water or other coolant is constantly circulated through the enclosure via inlet 156 and outlet 158 so that, as the reagent passes through the coil, the temperature is substantially reduced, preferably to approximately room temperature.

Within the transmittance chamber 154 is located a transmittance sensor 160 which is in turn connected to a colorimeter 162. The colorimeter 162 sends a beam of light at a predetermined wavelength to the transmittance sensor 160. Preferably the wavelength is in the area of 420 nm. By the signal returned by the sensor 160, the colorimeter 162 gives a reading of the absorbance of the light by the reagent in the transmittance chamber 154. If the pulp has been cooked to a relatively greater extent, the absorbance will be less, while if the pulp has been cooked to a lesser extent the absorbance will be greater. Knowing the consistency as determined in the test described above, the absorbance of the reagent gives the degree of cook of the pulp sample by means of a well known look-up table.

The heat exchanger 146 described above performs an important function because of the construction of the transmittance sensor 160, as shown in FIG. 6. The light from the colorimeter 162 is transmitted to the sensor 160 by a first fiber optics cable 164. At the sensor, the light beam passes to a reflector 166 which reflects the light back to a second fiber optic cable 168, which returns the light to the colorimeter 162 for analysis. The reflector 166 is supported spaced from the distal ends of the fiber optic cables 164 and 168 by one or more legs 170. Before the reagent is introduced into the transmittance chamber 154 it can be assumed that the temperature of the chamber is approximately room temperature. If the reagent is not cooled by the heat exchanger 146 prior to its introduction into the transmittance chamber, the legs 170 generally would deform because of the rapid temperature change from room temperature to the temperature of the uncooled reagent, resulting in a distortion of the amount of light reflected by the reflector 166, in turn giving misleading absorption readings at the colorimeter 162. The heat exchanger 146 prevents or substantially reduces this distortion and maintains the colorimeter readings true.

After the colorimeter readings are taken, the transmittance chamber 154 and reaction chamber 16 are flushed with water, such as from distilled water reservoir 172, and the system readied for another cycle.

While the apparatus hereinbefore described is effectively adapted to fulfill the aforesaid objects, it is to be understood that the invention is not intended to be limited to the particular preferred embodiments of on-line apparatus and method for determining the degree of completion of pulp cook herein set forth. Rather, it is to be taken as including all reasonable equivalents without departing from the scope of the appended claims.

I claim:

1. An apparatus for periodically analyzing pulp stock, containing wood pulp and water, in a pulp digester, to determine the amount of cooking to which said pulp has been subjected, comprising:

A. means for diluting a sample of said pulp stock from said digester;

B. means for determining the consistency of said sample, including:

(1) a reaction chamber for containing said sample, (2) compressing means for compressing said sample along a predetermined direction within said reaction chamber to a predetermined pressure, and (3) measuring means for measuring said compressed sample along said predetermined direction;

C. means for removing substantially all the water from said reaction chamber;

D. means for adding reagents to said reaction chamber after removal of said water, and for draining said reagents from said reaction chamber; and E. means for examining said reagents after said draining to determine the light absorbance of said reagents, comprising (1) a transmittance chamber, separate from said reaction chamber, means for transferring said reagents which have drained from said reaction chamber to said transmittance chamber, (2) colorimeter means comprising means for generating a beam of light of a predetermined wavelength and means for determining the amount of light asorbed by the reagent, (3) transmittance sensor means, positioned with respect to said transmittance chamber so as to transmit said beam of light from said colorimeter means through said reagents within said transmittance chamber and back to said colorimeter means.

2. An apparatus as recited in claim 1 wherein said means for generating said beam of light comprises means for generating a beam of light at a wavelength of about 420 nanometers.

3. An apparatus as recited in claim 1 further comprising means for maintaining the temperature of the reaction chamber at a predetermined temperature throughout the time the reagents are in the reaction chamber.

4. An apparatus as recited in claim 1 further comprising means for cooling said reagents to approximately room temperature after removal from said reaction chamber and prior to transferring them to said transmittance chamber.

* * * * *